United States Patent [19]

Kitada et al.

[11] Patent Number: 4,733,089

[45] **Date of Patent: * Mar. 22, 1988**

[54] RADIOGRAPHIC INTENSIFYING SCREEN

[75] Inventors: Akira Kitada; Terumi Matsuda, both of Kanagawa, Japan

[73] Assignee: Fuji Photo Film Co., Ltd., Japan

[ * ] Notice: The portion of the term of this patent subsequent to Mar. 11, 2003 has been disclaimed.

[21] Appl. No.: 821,888

[22] Filed: Jan. 27, 1986

Related U.S. Application Data

[63] Continuation of Ser. No. 485,833, Apr. 18, 1983, abandoned.

[30] Foreign Application Priority Data

Apr. 20, 1982 [JP] Japan ..... 57-64674

[51] Int. Cl.[4] ..... G21K 4/00

[52] U.S. Cl. ..... 250/483.1; 250/487.1

[58] Field of Search ..... 250/483.1, 486.1, 487.1; 427/157, 290

[56] References Cited

U.S. PATENT DOCUMENTS

| | | | |
|---|---|---|---|
| 2,882,413 | 4/1959 | Vingerhoets | 250/486.1 |
| 3,904,532 | 9/1975 | Christgau et al. | 250/483.1 |
| 3,915,809 | 10/1975 | Wheatley | 427/290 |
| 4,032,791 | 6/1977 | Chiola et al. | 427/157 |
| 4,090,085 | 5/1978 | Shimiya et al. | 250/486.1 |
| 4,106,859 | 8/1978 | Doriguzzi et al. | 427/290 |
| 4,575,635 | 3/1986 | Arakawa et al. | 250/484.1 |

*Primary Examiner*—Janice A. Howell
*Assistant Examiner*—Richard Hanig
*Attorney, Agent, or Firm*—Gerald J. Ferguson, Jr.; Michael P. Hoffman; Michael J. Foycik, Jr.

[57] ABSTRACT

A radiographic intensifying screen comprising a support and at least one phosphor layer comprising a binder and a phosphor dispersed therein. The sharpness of image provided by the screen and the adhesion between the phosphor layer and the support are both remarkably improved by providing onto the surface of the support a great number of pits having a mean depth of at least 1 μm, a maximum depth of more than 1 ranging to 50 μm, and a mean diameter at the opening of at least 1 μm.

8 Claims, 1 Drawing Figure

BEST AVAILABLE COPY

RADIOGRAPHIC INTENSIFYING SCREEN

This application is a continuation of Ser. No. 485,883, filed Apr. 18, 1983, now abandoned.

This invention relates to a radiographic intensifying screen and a process for the preparation of the same. More particularly, this invention relates to a radiographic intensifying screen comprising a support and at least one phosphor layer comprising a binder and a phosphor dispersed therein, and a process for the preparation of the same.

The radiographic intensifying screen is generally employed in close contact with one or both surfaces of an X-ray film for enhancing the photographic sensitivity of the film in a variety of radiographys such as medical radiography and industrial radiography. The radiographic intensifying screen consisits essentially of a support and a phosphor layer provided thereonto. Further, a transparent film is generally provided onto the free surface of the phosphor layer to keep the phosphor layer from chemical and physical deterioration.

The phosphor layer comprises a binder and a phosphor dispersed therein. The phosphor is in the form of small particles, and emits light of high luminance when excited by radiation such as X-rays. The light of high luminance emitted by the phosphor is in proportion to the dose of radiation energy transmitted through an object. The X-ray film positioned in close contact with the intensifying screen is exposed to the light emitted by the phosphor layer, as well as being exposed directly to the radiation energy transmitted through the object. Accordingly, the X-ray film receives radiation energy enough for formation of the radiation image of the object, even if the radiation is applied to the object at a relatively small dose.

In view of the above-described characteristics of the radiographic intensifying screen, it is desired that the screen shows a high radiographic speed, as well as provides excellent image characteristics such as sharpness and graininess. For the reason, various proposals have been previously given for the improvement of radiographic speed and image characteristics of the radiographic intensifying screen.

For instance, U.S. Pat. No. 4,207,125 describes an X-ray intensifying screen including an anti-reflecting surface at the back side of the luminous layer in which a plurality of randomly positioned leaflets extend from the surface, in which the layer is typically formed of a microstructured layer of boehmite, a hydrated aluminum oxide.

U. S. Pat. No. 4,236,061 describes an image intensifying screen comprising an antireflecting surface formed by subjecting a substantially planner aluminum surface on a support layer to a steam treatment to convert the aluminum surface to a microstructured surface of boehmite, a hydrated aluminum oxide, having a plurality of randomly positioned leaflets extending from the surface.

The radiographic intensifying screen also is ought to be so mechanically strong enough to keep itself from separation between the support and the phosphor layer when receives mechanical shocks such as bending in the course of radiographic procedures. The intensifying screen is chemically and physically resistant to radiographic rays, whereby the screen is employable for a long period even under the conditions of repeated uses. For this reason, the screen ought to be resistant to mechanical shocks given in the procedure for changing an X-ray film or other procedures so that it is free from separation between the support and the phosphor layer.

Accordingly, a primary object of the present invention is to provide a radiographic intensifying screen improved in the sharpness, and a process for the preparation of the same.

Another object of the invention is to provide a radiographic intensifying screen improved in the mechanical strength, particularly, strength in the adhesion between the support and the phosphor layer, and a process for the preparation of the same.

There is provided by the invention a radiographic intensifying screen comprising a support and at least one phosphor layer comprising a binder and a phosphor dispersed therein, in which the support is provided on the surface facing the phosphor layer with a great number of pits having a mean depth of at least a maximum depth of more than 1 μm to 100 μm and a mean diameter at the opening of at least 1 μm.

The radiographic intensifying screen of the invention can be prepared by a process comprising applying hard solid particles onto the surface of the support at high speed to form the pits.

BRIEF DESCRIPTION OF THE DRAWING

The present invention is now described hereafter in more detail with reference to the accompanying FIG. 1 which shows a vertical section of a radiographic intensifying screen according to the present invention in which 11 indicates a support having a great number of pits 12 on the surface, 13 indicates a phosphor layer, and 14 indicates a protective layer.

According to the invention, a radiographic intensifying screen producing on a radiographic film an image prominently improved in the sharpness, as well as being highly improved in the adhesion between the support and the phosphor layer, is obtained by providing a great number of pits having the specifically determined size onto the surface of the support on the side facing the phosphor layer.

Figure 1:
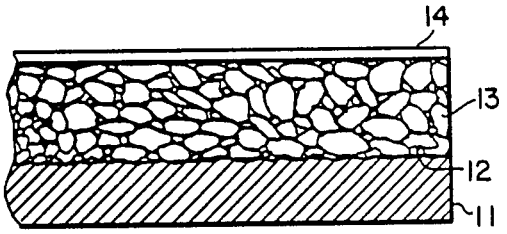

When radiation such as X-rays having passed through an object impinges upon the phosphor layer of a radiographic intensifying screen, the phosphor particles contained in the phosphor layer are excited upon absorbing the radiation energy and immediately emits light of a wavelength in the visible or near ultra-violet region which is different from the wavelength of the introduced radiation. The so emitted light advances in all directions, and a part of the light enters directly into a photosensitive layer of the film placed in contact with the screen so as to contribute the formation of a photographic image on the film. Another part of the light advances in the direction towards the interface between the phosphor layer and the support, and is reflected by the support surface to enter into the photosensitive layer through the phosphor layer, also contributing the formation of the photographic image. In the case of using a radiographic intensifying screen comprising a simply plane interface having no protrusions and depressions between the phosphor layer and the support, the reflection of light is done as the mirror plane reflection, whereby the reflected light enters into the film at an angle higher than the angle of the light directly entering into the film. Accordingly, the reflected light causes formation of an obscure image on the film, resulting in marked deterioration of the sharpness of image.

According to study of the present inventors, the deterioration of image formed on the radiographic film can be effectively prevented by providing a great number of pits having the specifically determined size, that is, a mean depth of at least 1 μm, a maximum depth of more than 1 μm, ranging to 50 μm and a mean diameter at the opening of at least 1 μm, onto a surface of the support facing the phosphor layer, that is, the interface therebetween.

The pits provided onto the surface of the support, as described above, further serves for enhancing the adhesion between the support and the phosphor layer, so that substantially no separation takes place in a normal procedure for handling the intensifying screen.

The radiographic intensifying screen of the present invention can be prepared in the manner as described below.

The support for constituting the intensifying screen of the invention can be prepared by the use of material selected from those known or employed in the preparation of various radiographic intensifying screens. Examples of the support material include plastic films such as films of cellulose acetate, polyester, polyethylene terephthalate, polyamide, polyimide, triacetate, and polycarbonate; metal sheets such as aluminum foil and aluminum alloy foil; ordinary papers; baryta paper; resin-coated papers; pigment papers containing titanium dioxide or the like; and papers sized with polyvinyl alcohol or the like. In other words, there is no specific limitation on the material of the support, as far as the material can accept on the surface the formation of pits specified in the description given hereinbefore. In view of easiness in formation of these pits on the surface, as well as characteristics of a radiographic intensifying screen prepared therefrom, a plastic film is preferably employed as the support material. The plastic film may contain a light-absorbing material such as carbon black, or may contain a light-reflecting material such as titanium dioxide. The former is appropriate for preparing a radiographic intensifying screen belonging to the acutance (high sharpness) type, while the latter is appropriate for preparing a radiographic intensifying screen belonging to the high speed type.

In the preparation of a conventional radiographic intensifying screen, one or more of additional layers are optionally provided between the support and the phosphor layer. For instance, a subbing layer or an adhesive layer may be provided by coating a polymer material such as gelatin over the surface of the support on the side to receive the phosphor layer. Otherwise, a light-reflecting layer or a light-absorbing layer may be provided by introducing a polymer material layer containing a light-reflecting material such as titanium dioxide or a light-absorbing material such as carbon black, respectively. Otherwise, a metal foil may be provided onto the surface of the support to receive the phosphor layer so as to remove scattered radiation in the radiographic intensifying screen to be employed in the industrial radiography. Such a metal foil can be chosen from lead foil, lead alloy foil, tin foil, and the like. Any one or more of these additional layers may be provided to the radiographic intensifying screen of the invention.

A great number of the pits specified herein can be provided onto the surface of support in an optionally chosen manner. Preferably, these pits are provided by a process comprising applying hard solid particles such as grits and sands onto the surface of support at high speed. The above-mentioned process is called "grit blasting" or "sand blasting". The hard solid particles can be applied onto the surface of support as such. Otherwise, a surface of an additional layer such as a subbing layer, light-reflecting layer, light-absorbing layer, or metal layer, can be subjected to the high speed blasting of hard solid particles. The materials of the hard solid particles employable for the sand blasting or grit blasting are known in the art. For instance, metal particles, metal oxide particles, or other inorganic material particles can be employed. The size of the hard solid particles and the conditions for carrying out the above-mentioned process for the provision of the pits can be determined according to those known in the art.

In the case using the radiographic intensifying screen of the invention in contact with a radiographic film, a part of the light that is emitted by the phosphor upon receiving radiation having passed through an object and then advances toward the surface of the support layer (the interface between the phosphor layer and the support) is reflected diffusely by the surface provided with a great number of the pits having the specific dimension, whereby most of the reflected light is absorbed by the phosphor layer, not reaching the photosensitive layer of the radiographic film placed in contact therewith. Accordingly, the sharpness of the image produced on the radiographic film is prominently enhanced.

Moreover, as described hereinbefore, the provision of a great number of pits having dimensions in the ranges defined herein onto the surface of the support improves the adhesion between the phosphor layer and the support of the radiographic intensifying screen.

In contrast, if pits provided onto the support surface have dimension substantially deviated from the ranges defined as hereinbefore for the present invention, the prominent improvement both in the sharpness of a formed image and adhesion between the phosphor layer and the support are hardly attained.

If the pits are smaller than those defined hereinbefore, most of the light reflected by the support surface probably is not diffused and rather straightly advances toward the radiographic film, whereby no substantial improvement in the sharpness of image can be attained. Also unattainable is substantial enhancement of the adhesion between the phosphor layer and the support.

If the pits are larger than those defined hereinbefore, the phosphor layer with plane surface and even phase conditions are hardly prepared on the support, giving unfavorable factors to the intensifying screen.

The pits provided onto the surface of the support of the radiographic intensifying screen according to the present invention preferably have a mean depth of 1–10 μm, inclusive, more preferably 1–5 μm, inclusive; a maximum depth of more than 1 μm ranging to 50 μm, more preferably 2–20 μm, inclusive; and a mean diameter at the opening of 1–100 μm, inclusive, more preferably 10–50 μm, inclusive. The radiographic intensifying screen provided onto the support surface with a great number of pits as specified above is particularly improved in the sharpness and the adhesion between the phosphor layer and the support Onto the surface of the support provided with a great number of the pits is provided a phosphor layer.

The phosphor layer comprises a binder and a phosphor in the form of particles dispersed therein. There are known a variety of phosphors employable for a radiographic intensifying screen. Examples of the phosphors preferably employable in the present invention include:

tungstate type phosphors such as $CaWO_4$, $MgWO_4$, and $CaWO_4$:Pb;

terbium activated rare earth metal oxysulfide type phosphors such as $Y_2O_2S$:Tb, $Gd_2O_2S$:Tb, $La_2O_2S$:Tb, $(Y,Gd)_2O_2S$:Tb,and $(Y,Gd)_2O_2S$:Tb,Tm;

terbium activated rare earth phosphate type phosphors such as $YPO_4$:Tb, $GdPO_4$:Tb, and $LaPO_4$:Tb;

terbium activated rare earth oxyhalide type phosphors such as LaOBr:Tb, LaOBr:Tb,Tm, LaOCl:Tb, LaOCl:Tb,Tm, GdOBr:Tb, and GdOCl:Tb;

thulium activated rare earth oxyhalide type phosphors such as LaOBr:Tm and LaOCl:Tm;

barium sulfate type phosphors such as $BaSO_4$:Pb, $BaSO_4$:$Eu^{2+}$, and $(Ba,Sr)SO^4$:$Eu^{2+}$;

divalent europium activated alkaline earth metal phosphate type phosphors such as $Ba_2(PO_4)_2$:$Eu^{2+}$, and $(Ba,Sr)_2(PO_4)_2$:$Eu^{2+}$;

divalent europium activated alkaline earth metal fluorohalide type phosphors such as BaFCl:$Eu^{2+}$, BaFBr:$Eu^{2+}$, BaFCl:$Eu^{2+}$, Tb, BaFBr:$Eu^{2+}$,Tb, $BaF_2.BaCl_2.KCl$:$Eu^{2+}$, $BaF_2.BaCl_2.xBaSO_4.KCl$:$Eu^{2+}$, and $(Ba,Mg)F_2.BaCl_2.KCl$:$Eu^{2+}$;

iodide type phosphors such as CsI:Na, CsI:Tl, NaI:Tl, and KI:Tl;

sulfide type phosphors such as ZnS:Ag, (Zn,Cd)S:Ag, (Zn,Cd)S:Cu, and (Zn,Cd)S:Cu,Al; and hafnium phosphate type phosphors such as $HfP_2O_7$:Cu.

The above-described phosphors are given by no means to restrict the phosphor employable in the present invention. Any other phosphor can be optionally employed, provided that the phosphor emits light in the visible or near ultra-violet region upon exposed to radiation.

Examples of the binder contained in the phosphor layer include: natural polymers such as proteins (e.g. gelatin), polysaccharides (e.g. dextran) and gum arabic; and synthetic polymers such as polyvinyl butyral, polyvinyl acetate, nitrocellulose, ethylcellulose, vinylidene chloride-vinyl chloride copolymer, polymethyl methacrylate, vinyl chloride-vinyl acetate copolymer, polyurethane, cellulose acetate butyrate, polyvinyl alcohol, and linear polyester. Particularly preferred binders are nitrocellulose, linear polyester, and a mixture of nitrocellulose and linear polyester.

The phosphor layer can be formed on the support in the following procedure.

The phosphor particles and binder are mixed in the presence of a sufficient amount of a solvent to prepare a coating dispersion containing the phosphor particles dispersed homogeneously in the binder solution. Examples of the solvent employable in the preparation of the coating dispersion include lower alcohols such as methanol, ethanol, n-propanol, and n-butanol; chlorinated hydrocarbons such as methylene chloride and ethylene chloride; ketones such as acetone, methyl ethyl ketone and methyl isobutyl ketone; esters of lower alcohols with lower aliphatic acids such as methyl acetate, ethyl acetate, and butyl acetate; ethers such as dioxane, ethylene glycol monoethylether, and ethylene glycol monomethylether; and mixtures of the above-mentioned compounds.

The ratio between the binder and the phosphor in the coating dispersion may be determined according to the aimed characteristics of the radiographic intensifying screen and nature the phosphor employed. Generally, the ratio therebetween is in the range of from 1:1 to 1:100 (binder : phosphor, by weight), preferably 1:8 to 1:40.

The coating dispersion may contain a dispersing agent for assisting dispersion of the phosphor particles in the solution, a plasticizer for increasing the adhesion between the binder and the phosphor particles in the phosphor layer, and/or other additives. Examples of the dispersing agent include phthalic acid, stearic acid, capric acid, and hydrophobic surface active agents. Examples of the plasticizer include phosphates such as triphenyl phosphate, tricresyl phosphate, and diphenyl phosphate; phthalates such as diethyl phthalate and dimethoxyethyl phthalate; glycolates such as ethylphthalyl ethyl glycolate and butylphthalyl butyl glycolate; and polyesters of polyethylene glycols with aliphatic dioarboxylic acids such as polyester of triethylene glycol with adipic acid and polyester of diethylene glycol with succinic acid.

The coating dispersion containing the phosphor particles and binder prepared as above is coated evenly over the surface of the support provided with a great number of the pits having the specific dimension. The coating procedure can be carried out by a conventional method such as a method using a doctor blade, roll coater, or knife coater.

The so coated layer is then heated slowly to dryness, so as to complete the formation of the phosphor layer on the support. The thickness of the phosphor layer varies depending upon the aimed characteristics of the intensifying screen, nature of the phosphor particles, the ratio between the binder and the phosphor particles, etc. Generally, the thickness of the phosphor layer is in the range of from 20 μm to 1 1 mm. The thickness in the range of 50–500 μm is preferred.

The phosphor layer can be provided onto the support in a different manner. For instance, the phosphor layer is independently prepared on a sheet such as a glass plate, metal plate, or plastic sheet, by the use of the aforementioned coating dispersion. The so prepared phosphor layer is then transferred onto the support by pressing the phosphor layer thereonto or laminating the phosphor layer on the support by the use of an adhesive agent.

As mentioned hereinbefore, the conventional radiographic intensifying screen generally has transparent film on the surface of the phosphor layer to protect the phosphor layer from physical and chemical deterioration. Accordingly, the radiographic intensifying screen of the present invention likewise has such a transparent film for the same purpose.

The transparent film can be provided onto the phosphor layer by coating the surface of the phosphor layer with a polymer solution containing a transparent polymer such as a cellulose derivative (e.g. cellulose acetate or nitrocellulose), or a synthetic polymer (e.g. polymethyl methacrylate, polyvinyl butyral, polyvinyl formal, polycarbonate, polyvinyl acetate, or vinyl chloride-vinyl acetate copolymer). Otherwise, a transparent parent film prepared independently from polyethylene terephthalate, polyethylene, polyvinylidene chloride, polyamide or the like can be placed and fixed on the support by the use of an appropriate adhesive agent to provide the protective film. The transparent protective film preferably has a thickness in the range of approximately 2–20 μm.

The present invention is further described by the following examples, which are by no means intended to restrict the invention.

EXAMPLE 1

A surface of a polyethylene terephthalate film containing titanium dioxide (support, thickness 250 μm) was subjected to sand blasting employing silica sand in which more than approximately 50% by weight of the silica particles had 100–150 mesh size. The sand blasting was carried under centrifugal force by applying to the support surface the silica particles supplied from a drum rotating at a speed of 1900 r.p.m. Thus, a rough surface was provided onto the support. The so prepared surface of the support was provided with a great number of pits having a mean diameter of 2 μm, a maximum depth of 7 μm, and a mean diameter at tne opening of 20 μm.

Independently, to a mixture of a particulated terbium activated gadolinium oxysulfide phosphor ($Gd_2O_2S$:Tb) and a linear polyester resin were successively added methyl ethyl ketone and nitrocellulose (nitrofication degree 11.5%) to prepare a phosphor dispersion. To the phosphor dispersion were further added tricresyl phosphate, n-butanol and methyl ethyl ketone. The mixture was sufficiently stirred by means of a propeller agitater to obtain a homogeneous coating dispersion having a viscosity of 25–35 PS (at 25° C.).

The coating dispersion was applied to the sandblasted surface of the support placed horizontally on a glass plate. The coating procedure was carried out using a doctor blade. The support boated with the dispersion thereon was then placed in an oven and heated therein at a temperature slowly varying from 25° to 100° C. Thus, a phosphor layer having the thickness or approximately 180 μm was formed on the support.

On the phosphor layer of the support was placed a transparent polyethylene terephthalate film (thickness: 12 μm; having a polyester adhesive layer) to combine the transparent film and the phosphor layer through the adhesive layer.

Thus, a radiographic intensifying screen consisting of a support, a phosphor layer and a transparent protective film was prepared.

COMPARISON EXAMPLE 1

The procedure of Example 1 was repeated except that no sand blasting was applied to the polyethylene terephthalate film containing titanium dioxide, to prepare a radiographic intensifying screen consisting of a support, a phosphor layer and a transparent protective film.

COMPARSION EXAMPLE 2

The procedure of Example 1 was repeated except that the sand blasting to the surface of the support was carried out using silica sand in which more than approximately 50% by weight of the silica particles had approximately 300 mesh size. The so processed surface of the support was provided with a great number of pits having a mean diameter of 0.2 μm, a maximum depth of 0.8 μm, and a mean diameter at the opening of 0.5 μm.

A radiographic intensifying screen consisting of a support, a phosphor layer and a transparent protective film was then prepared in the same manner as described in Example 1.

The radiographic intensifying screens prepared in the above-described examples were evaluated on the sharpness of image and the adhesion strength of the phosphor layer to the support. The evaluation methods are given below:

(1) Sharpness of image

The radiographic intensifying screen was combined with an X-ray film in a cassette, and exposed to X-rays of 80 KVp through an MTF chart. The film was then developed to obtain a visible image, and the MTF value was determined. In Table 1 the MTF value is set forth as as value (%) at the spacial frequency of 2 cycle/mm. A relative radiographic speed is also set forth in Table 1.

(2) Adhesion strength of phosphor layer to support

The radiographic intensifying screen was cut to give a test strip (1 cm×6 cm), and an adhesive polyester tape was stuck on protective film of the support. The so prepared test strip was then given on the adhesive tape side a U-shaped cut having a depth reaching the interface between the phosphor layer and the support by means of a knife. The U-shaped cut was made along the longitudinal direction of the strip.

In a tensile testing machine (Tensilon UTM-11-20 manufactured by Toyo Baldwin Co., Ltd., Japan), tne U-shaped cut portion and the remaining strip portion were forced to separate from each other by pulling up the tab end of the cut portion at a rate of 2 cm/min. The adhesion strength was determined just when a 1-cm long portion of the phosphor layer was separated from the support. The strength is expressed in terms of the force F (g/cm).

The results are set forth in Table 1.

TABLE 1

| | Ex. 1 | Com. Ex. 1 | Com. Ex. 2 |
|---|---|---|---|
| Sharpness | 0.27 | 0.23 | 0.24 |
| Adhesion strength | 300 | 100 | 120 |
| Relative radiographic speed | ≦95 | 100 | 95–100 |

EXAMPLE 2

The sand blasting procedure of Example 1 was repeated except that the polyethylene terephthalate film containing titanium dioxide was replaced with a polyethylene terephthalate film having the same thickness but containing carbon black. The so processed surface of the support was provided with a great number of pits having a mean diameter of 2 μm, a maximum depth of 7 μm, and a mean diameter at the opening to 20 μm.

Subsequently, a radiographic intensifying screen consisting of a support, a phosphor layer and a transparent protective film was prepared in the same manner as described in Example 1.

COMPARISON EXAMPLE 3

The procedure of Example 2 was repeated except that no sand blasting was applied to the polyethylene terephthalate film containing carbon black, to prepare a radiographic intensifying screen consisting of a support, a phosphor layer and a transparent protective film.

Each of the screens prepared in Example 2 and Comparison Example 3 was evaluated on the sharpness of image and the adhesion strength of the phosphor layer to the support in the same manner described previously. The results are set forth in Table 2.

TABLE 2

| | Ex. 2 | Com. Ex. 3 |
|---|---|---|
| Sharpness | 0.34 | 0.28 |
| Adhesion strength | 350 | 140 |
| Relative radiogra- | 95–100 | 100 |

TABLE 2-continued

| | Ex. 2 | Com. Ex. 3 |
|---|---|---|
| phic speed | | |

EXAMPLE 3

The procedure of Example 2 was repeated except that the particulated terbium activated gadolinium oxysulfide phosphor was replaced with a particulated divalent europium activated barium fluorobromide ($BaFBr:Eu^{2+}$) phosphor, to prepare a radiographic intensifying screen consisting of a support, a phosphor layer, and a transparent protective film.

COMPARISON EXAMOLE 4

The procedure of Example 3 was repeated except that no sand blasting was applied to the polyethylene terephthalate film containing carbon black, to prepare a radiographic intensifying screen consisting of a support, a phosphor layer and a transparent protective film.

Each of the screens prepared in Example 3 and Comparison Example 4 was evaluated on the sharpness of image and the adhesion strength of the phosphor layer to the support in the same manner described previously. The results are set forth in Table 3.

TABLE 3

| | Ex. 3 | Com. Ex. 4 |
|---|---|---|
| Sharpness | 0.38 | 0.34 |
| Adhesion strength | 320 | 150 |
| Relative radiographic speed | 95–100 | 100 |

EXAMPLE 4

The procedure of Example 2 was repeated except that the particulated divalent europium activated barium fluorobromide ($BaFBr:Eu^{2+}$) phosphor was replaced with a calcium tangustate ($CaWO_4$) phosphor, to prepare a radiographic intensifying screen consisting of a support, a phosphor layer, and a transparent protective film.

COMPARISON EXAMPLE 5

The procedure of Example 4 was repeated except that no sand blasting was applied to the polyethylene terephthalate film containing carbon black, to prepare a radiographic intensifying screen consisting of a support, a phosphor layer and a transparent protective film.

Each of the screens prepared in Example 4 and Comparison Example 5 was evaluated on the sharpness of image and the adhesion strength of the phosphor layer to the support in the same manner described previously. The results are set forth in Table 4.

TABLE 4

| | Ex. 4 | Com. Ex. 5 |
|---|---|---|
| Sharpness | 0.54 | 0.50 |
| Adhesion strength | 400 | 220 |
| Relative radiographic speed | 95–100 | 100 |

We claim:

1. A radiographic intensifying screen, comprising a support of a plastic film and at least one phosphor layer comprising a binder and a phosphor dispersed therein, in which said support is provided on a surface facing said phosphor layer with a great number of pits having a mean depth of 1–10 μm, inclusive, a maximum depth of more than 1 μm ranging to 50 μm, inclusive, and a means diameter of 10–50 μm, inclusive, whereby light emitted by said phosphor and advancing towards said surface of said support is reflected diffusely.

2. The radiographic intensifying screen as claimed in claim 1, in which said pits have a means depth of 1–5 μm, inclusive.

3. The radiographic intensfying screen as claimed in claim 1, which said pits have a maximum depth of 2–20 μm, inclusive.

4. The radiographic intensifying screen as claimed in claim 1, 2 or 3, in which said binder comprises a linear polyester as a principal component.

5. The radiographic intensifying screen as claimed in claim 1, 2 or 3 in which said binder comprises nitrocellulose as a principal component.

6. The radiographic intensifying screen as claimed in claim 1, 2 or 3, in which said binder comprises a mixture of a linear polyester and nitrocellulose as a principal component.

7. The radiographic intensifying screen as claimed in claim 1, 2 or 3, in which said pits are those formed by applying hard solid particles onto the surface of said support at high speed.

8. A process for the preparation of a radiographic intensifying screen comprising a support of a plastic film and at least one phosphor layer comprising a binder and a phosphor dispersed therein, in which said support is provided on a surface facing said phosphor layer with a great number of pits having a mean depth of 1–10 μm, inclusive, a maximum depth of the than 1 μm ranging to 50 μm, inclusive, and a mean diameter of 10–50 μm, inclusive, said process comprising applying hard solid particles onto said surface of said support at high speed to form said pits.

* * * * *